US007128369B2

(12) United States Patent
Boggs et al.

(10) Patent No.: US 7,128,369 B2
(45) Date of Patent: Oct. 31, 2006

(54) PORTABLE COMBINATION COOLER AND CUSHIONED SEAT

(76) Inventors: Karen L. Boggs, 23705 Sparrow Ct., Petersburg, VA (US) 23803; John R. Weeks, III, 23618 River Rd., Petersburg, VA (US) 23803

( * ) Notice: Subject to any disclaimer, the term of this patent is extended or adjusted under 35 U.S.C. 154(b) by 267 days.

(21) Appl. No.: 10/864,516

(22) Filed: Jun. 10, 2004

(65) Prior Publication Data

US 2005/0274726 A1 Dec. 15, 2005

(51) Int. Cl.
*A47C 7/62* (2006.01)
*A47C 15/00* (2006.01)
*A47D 1/10* (2006.01)

(52) U.S. Cl. ..... 297/188.08; 297/188.01; 297/188.11; 297/188.12; 297/188.13; 297/252; 297/352

(58) Field of Classification Search ..... 297/188.08, 297/188.11, 188.12, 188.13, 252, 352, 188.01
See application file for complete search history.

(56) References Cited

U.S. PATENT DOCUMENTS 1,156,367 A * 10/1915 Masler ..... 297/188.13
2,264,744 A 3/1941 Dunnam ..... 297/188.11 X
2,327,288 A * 8/1943 Post ..... 297/188.08
D180,542 S 7/1957 Barrow
D197,558 S 2/1964 Sokolis
3,120,404 A * 2/1964 Bramming ..... 297/188.08 X
D200,309 S 2/1965 Sokolis ..... 297/188.08 X
3,230,006 A * 1/1966 Sokolis ..... 297/188.11 X
D240,781 S 8/1976 Kohler
4,248,476 A * 2/1981 Phelps ..... 297/188.11 X
D274,581 S 7/1984 Gallock
4,474,407 A * 10/1984 Nazar ..... 297/188.13
4,556,250 A 12/1985 Chapman et al. ... 297/188.13 X
4,652,048 A 3/1987 Nazar ..... 297/188.13 X
4,715,652 A * 12/1987 Ward ..... 297/252
D298,186 S 10/1988 Brannon
4,799,731 A * 1/1989 Brown ..... 297/188.12
4,883,317 A * 11/1989 Davenport ..... 297/188.11 X
4,925,245 A * 5/1990 Pendleton et al. .. 297/188.11 X
5,050,767 A * 9/1991 Peer ..... 297/188.12 X
5,100,198 A 3/1992 Baltzell
D330,639 S 11/1992 Munro et al. ..... 297/188.1 X
5,395,157 A * 3/1995 Rollo et al. ..... 297/188.11 X
5,435,642 A * 7/1995 Kennedy ..... 297/188.11 X
5,524,957 A * 6/1996 Gibriano ..... 297/188.11 X
5,641,197 A * 6/1997 Springmann ..... 297/188.11
5,660,296 A 8/1997 Greenwich ..... 297/188.08 X
5,692,335 A * 12/1997 Magnuson ..... 297/188.08 X
5,727,844 A 3/1998 O'Quinn et al. .... 297/188.13 X
6,079,599 A * 6/2000 Nordstrom et al. . 297/188.12 X
6,145,931 A * 11/2000 Subotic ..... 297/188.11 X
6,341,817 B1 1/2002 Stern-Gonzalez ..... 297/188.01
6,390,551 B1 * 5/2002 Hendrickson ..... 297/188.08 X

* cited by examiner

*Primary Examiner*—Rodney B. White
(74) *Attorney, Agent, or Firm*—Richard C. Litman

(57) ABSTRACT

The portable combination cooler and cushioned seat is a cooler and seat combination configured for easy and quick attachment to a standard stadium bench. The cooler has an insulated six-sided housing with a drawer for storing food and beverages. Attached to the top of the housing is a set of seat mounting brackets, each with a collapsible back support, which facilitates mounting onto a standard stadium bench seat. A folding cushioned seat is attached to the top of the seat mounting brackets. The housing also includes a retractable table, an elastic side pouch and a detachable carrying strap.

10 Claims, 4 Drawing Sheets

PORTABLE COMBINATION COOLER AND CUSHIONED SEAT

BACKGROUND OF THE INVENTION

1. Field of the Invention

The present invention relates to coolers, and more particularly to a portable cooler and seat combination that can be slidably attached to a stadium bench with the cooler positioned under the bench and the seat positioned on top of the bench.

2. Description of the Related Art

Conventional coolers are known in the art and generally consist of an insulated container for keeping food and beverages cool at an outdoor location. Typically, a cooler has six sides including a top, bottom, front, back, left side and right side. The top often is comprised of a removable lid that provides access to the contents of the cooler and also serves as a makeshift seat when the cooler is closed.

A notable drawback of a conventional cooler is that it is bulky and cumbersome. For example, when brought to an event taking place in a stadium, such as a NASCAR race or an athletic event, a conventional cooler must often be placed on a stadium bench, where it takes up valuable seating space, or where it must be stored in an aisle, stairway or walkway, thereby obstructing easy passage for patrons.

Additionally, when used as a seat, the top of a conventional cooler is not comfortable and does not provide enough space to also set a drink or other item thereon. Furthermore, as items within the cooler are desired, a person sitting on the cooler must repeatedly stand up.

Therefore, a need exists for a portable cooler that can be used in a stadium without taking up seating space or restricting access to aisles, stairways or walkways. Additionally, a need exists for a cooler that can be used as a seat where the person sitting on the cooler is comfortable and does not have stand up each time the contents of the cooler is accessed. Furthermore, a need exists for a cooler that can be used as a seat in conjunction with a standard stadium bench to provide comfortable seating while allowing the cooler to be stored in an out-of-the-way place.

U.S. Design Pat. No. 330,639, issued Nov. 3, 1992 to D. S. Munro et al., shows a portable seat having a seat portion, a backrest and a cooler compartment that is accessed by lifting the seat portion. Because the cooler compartment is accessed by lifting the seat portion, a person sitting on the device must stand up each time the cooler is accessed. Additionally, if used by a person sitting on a bench, the person is elevated by the height of the cooler compartment, and thereby his or her feet may be unable to reach the ground.

U.S. Pat. No. 5,100,198, issued Mar. 31, 1992 to R. L. Baltzell, describes a combined set and cooler adapted for use on a beach. The device is not useful for providing comfortable seating in conjunction with a stadium bench nor is it adapted to out-of-the-way storage.

U.S. Design Pat. Nos. 197,558 and 200,309, issued Feb. 25, 1964 and Feb. 16, 1965, respectively, to A. Sokolis (combined folding chair and tackle box); and U.S. Design Pat. No. 298,186 issued Oct. 25, 1988 to J. J. Brannon (combined seat and cooler unit), each show a combination seat and container with a removable or foldable backrest and with a lid serving as the top to the container. Because the lid must be opened to access the contents of the container, a person sitting on the seat must stand up each time the container is accessed.

U.S. Design Pat. No. 180,542, issued Jul. 2, 1957 to S. Barrow (sewing chair); U.S. Design Pat. No. 240,781 issued Aug. 3, 1976 to K. R. Kohler (fisherman's chair); U.S. Design Pat. No. 274,581 issued Jul. 10, 1984 to J. P. Gallock (combination chair and drawer); U.S. Pat. No. 2,264,744 issued Mar. 3, 1941 to R. A. Dunnam (combined tackle box and seat); and U.S. Pat. No. 4,652,048 issued Mar. 24, 1987 to R. C. Nazar (portable adjustable chair with insulated seat cooler), all teach a device incorporating a seat disposed on top of a housing that has a drawer or other laterally accessed compartment. None of the devices, however, is suitable for use in conjunction with a stadium bench.

U.S. Pat. No. 5,660,296, issued Aug. 26, 1997 to R. E. Greenwich (mobile cooler having a removable cover usable as a chair); U.S. Pat. No. 5,727,844, issued Mar. 17, 1998 to J. L. O'Quinn et al. (cooler seat system); and U.S. Pat. No. 6,341,817, issued Jan. 29, 2002 to E. Stern-Gonzalez (conventional cooler with reclinable seat back and seat), all teach conventional coolers with lids adapted for a person to sit on. The coolers are cumbersome and a person using one as a seat would have to stand up each time its contents is accessed.

None of the above inventions and patents, taken either singly or in combination, is seen to describe the instant invention as claimed. Thus, a portable combination cooler and cushioned seat adapted for attachment to a bench solving the aforementioned problems is desired.

SUMMARY OF THE INVENTION

The portable combination cooler and cushioned seat of the present invention is a cooler and seat combination configured for easy and quick attachment to a standard stadium bench. The cooler includes an insulated six-sided housing with a drawer for storing food and beverages. Attached to the top of the housing is a set of seat mounting brackets, each with a collapsible back support that facilitates mounting onto a standard stadium bench seat. A folding cushioned seat is attached to the top of the seat mounting brackets. The housing also includes a retractable table, an elastic side pouch and a detachable carrying strap.

The combination cooler and cushioned seat allows a person attending a NASCAR race, or other sporting event held at a stadium with benches, to attach the cooler to the underside of a bench while using the foldable cushioned seat as a comfortable seat with a backrest. Used in this manner, it allows a person to keep chilled food and beverages close at hand while allowing access to the food and beverages without having to stand up. The device has a retractable table on which items can be set, a detachable carrying strap, and an elastic side pouch.

Accordingly, it is a principal object of the invention to provide a device that combines a portable cooler with a foldable cushioned seat that can be slidably attached to a stadium bench.

It is another object of the invention to provide a device that combines a portable cooler with a foldable cushioned seat that allows access to food and beverage stored in the cooler while a person is sitting on the device.

It is a further object of the invention to provide a device that combines a portable cooler with a foldable cushioned seat that includes a detachable carrying strap for ease of carrying and an elastic pouch for storing loose items.

Still another object of the invention is to provide a portable combination cooler and cushioned seat that includes a retractable table to set items on while a person is sitting on the device.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
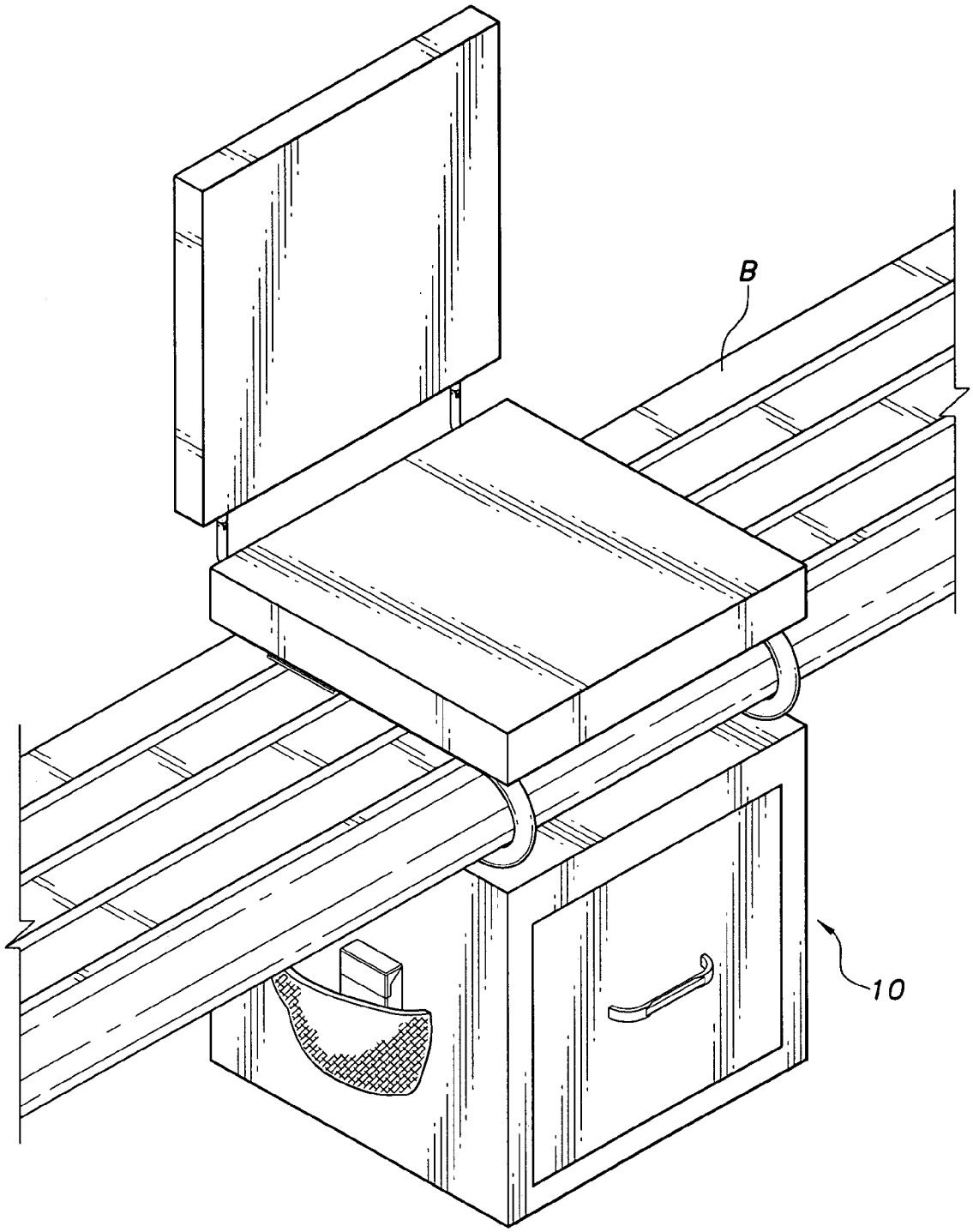
FIG. 1 is an environmental, perspective view of a portable combination cooler and cushioned seat according to the present invention shown secured to a stadium bench.

The present invention is a portable combination cooler and cushioned seat, designated generally as 10 in the drawings. As shown in FIG. 1, the cooler 10 provides a cushioned seat attachable to a bench B and having a backrest, the cooler 10 being stored beneath the bench B to provide clear access to the aisles.

Figure 2:
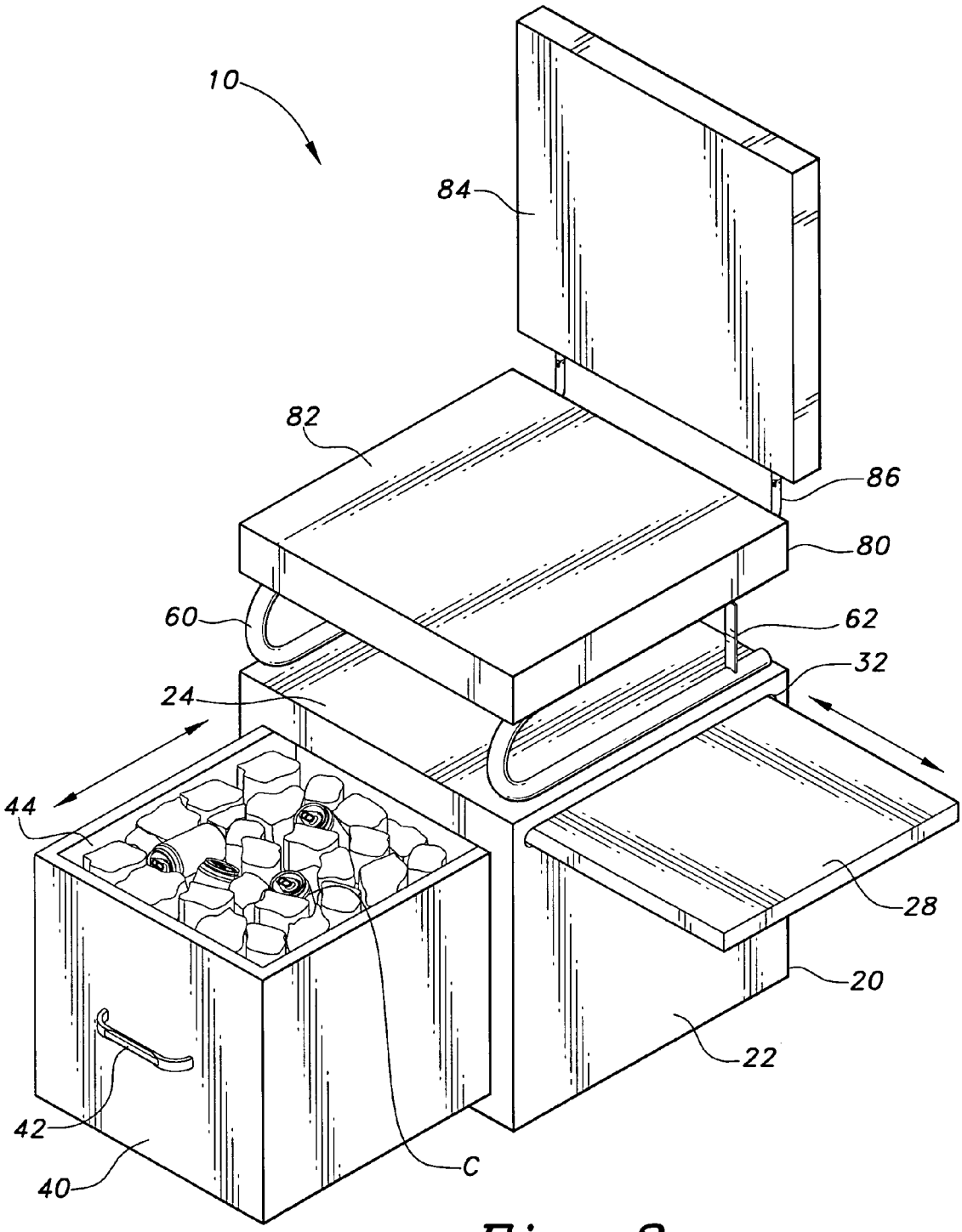
FIG. 2 is a perspective view of the portable combination cooler according to the present invention with its retractable table extended and its drawer open.
Figure 3:
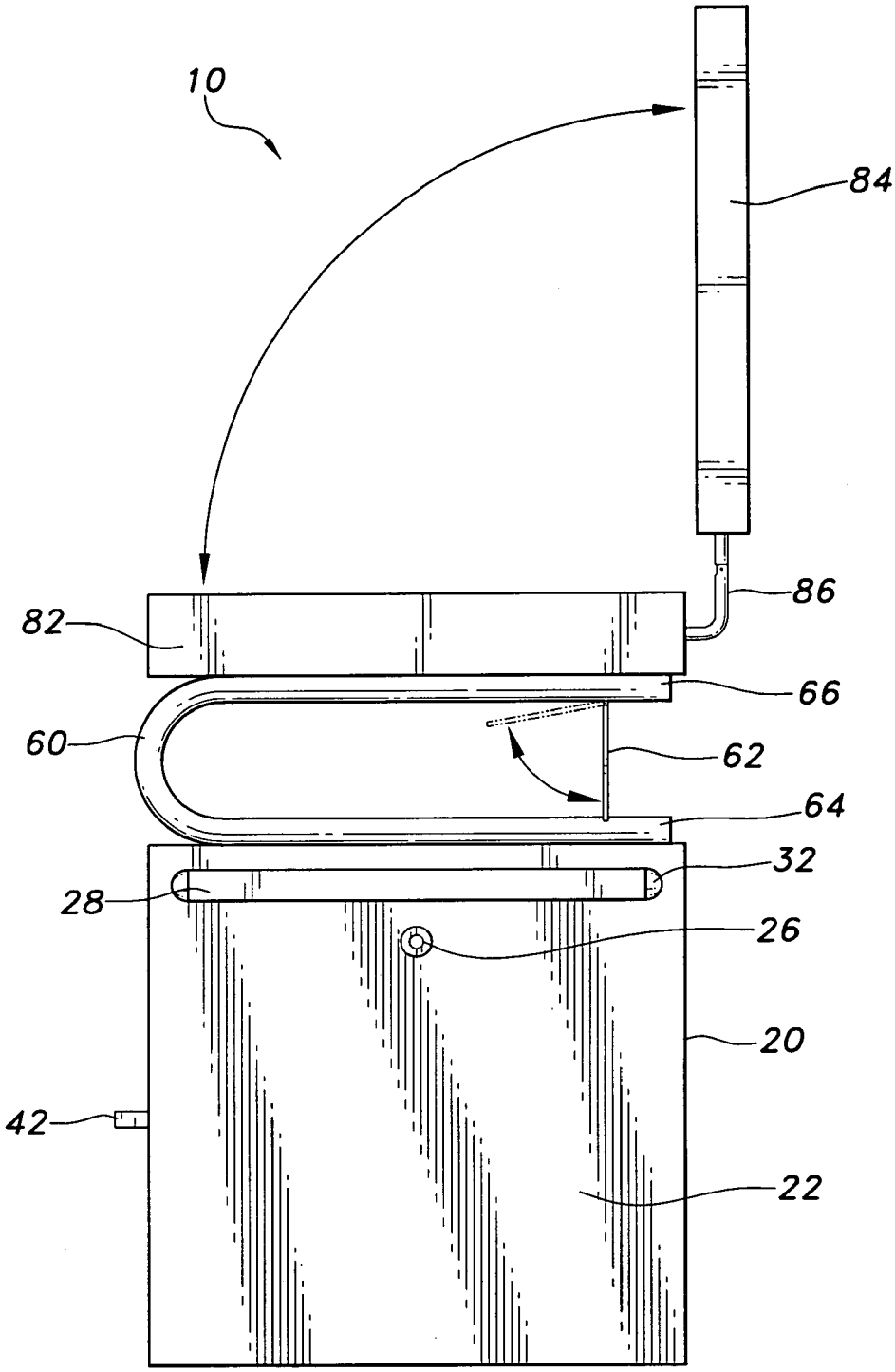
FIG. 3 is a side view of the portable combination cooler according to the present invention.
Figure 4:
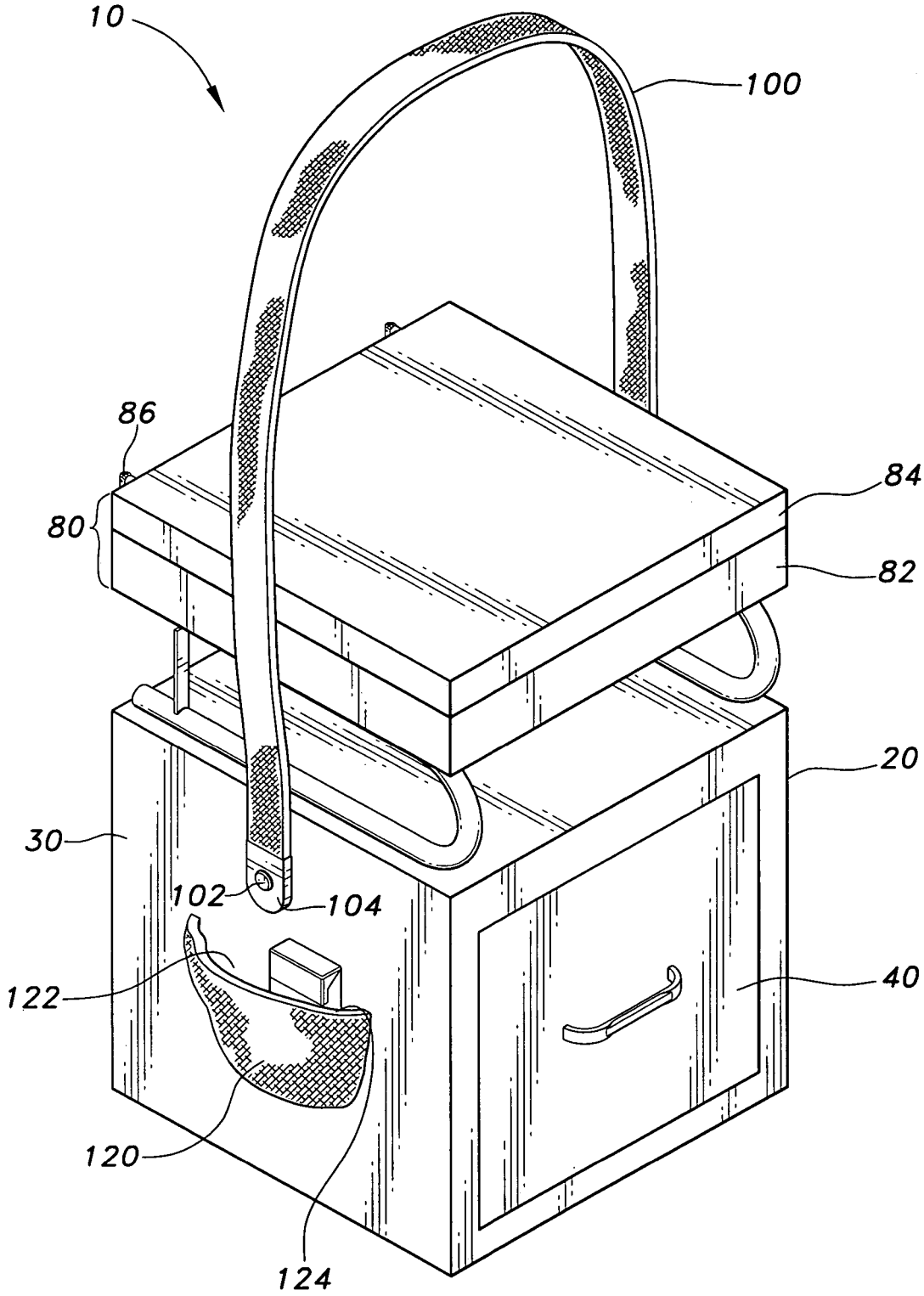
FIG. 4 is a perspective view of the portable combination cooler with the removable carrying strap attached.

Referring to FIGS. 2, 3 and 4, the cooler 10 includes a housing 20, a drawer 40, a set of seat mounting brackets 60, a foldable cushioned seat 80, a retractable table 28, a detachable carrying strap 100 and an elastic side pouch 120.

The housing 20 is a six-sided box constructed with a top wall 24, a bottom wall, a back wall, two side walls 22 and 30 and a substantially open front that forms a drawer cavity. The housing 20 is adapted to house a drawer 40 in a slidable manner for opening and closing of the drawer 40. An elastic side pouch 120 is attached to one side 30 of the housing 20 and a slot 32 adapted for supporting a retractable table 28 is accessible from the other side 22 of the housing 20. A set of seat mounting brackets 60 is attached to the top 24 of the housing.

The drawer 40, as reflected in FIG. 2, has a front panel, back panel, a bottom panel, two side panels and an open top that form a storage space 44 for food, ice and beverages C. The drawer 40 has a handle 42 attached to the outer aspect of its front panel and slides between a closed position in which the drawer 40 is contained within the housing 20 and an open position in which drawer 40 extends from the housing 20 with storage space 44 exposed and accessible.

The housing 20 and drawer 40 are constructed of plastic or other heat insulating material.

The retractable table 28 is substantially flat and is slidably disposed in the housing 20 in a manner allowing for horizontal movement between a retracted position in which table 28 is substantially contained within the housing 20 and an extended position in which table 28 extends laterally from the housing 20 for supporting an object, as reflected in FIG. 2.

The elastic side pouch 120, shown in FIG. 4, is constructed of a panel of elastic mesh material that has a bottom edge, top edge 124 and two side edges. The bottom and side edges of the panel are secured to one side 30 of the housing 20, and the top edge 124 of the panel forms an opening 122 through which items can be deposited and retrieved from the pouch 120.

The set of seat mounting brackets 60 includes two tubular C-shaped brackets 60. The bottom arm 64 of each bracket 60 is attached to the top 24 of the housing 20 and extends substantially from the front of the housing 20 to the back of the housing 20. A collapsible back support 62 is pivotally attached to the top arm 66 of each bracket 60. Each collapsible back support 62 pivots between a vertical position in which support 62 extends between the upper arm 66 and the lower arm 64, and a collapsed horizontal position in which support 62 is parallel to upper arm 66 to allow the C-shaped bracket 60 to be slid onto a stadium bench B, as reflected in FIGS. 1 and 3. Each bracket 60 is constructed of metal.

The foldable cushioned seat 80 has a seat portion 82 that is constructed of a cushioning material and a back portion 84 that is pivotally mounted to the seat portion 82 via two elongated brackets with integrated hinges 86. The seat portion 82 is mounted to the upper arms 66 of the seat mounting brackets 60. As reflected in FIG. 3, the back portion 84 pivots between an upright position in which back portion 84 can support the back of a person seated on the seat portion 82 and a horizontal position in which back portion 84 allows for ease in carrying the cooler 10. The back portion 84 is constructed of plastic, wood or cushioned material.

The detachable carrying strap 100, as shown in FIG. 4, is an elongated strap constructed of a pliable material that has the female component 102 of a snap attached to each of its two ends 104. The male component 26 of each snap (shown in FIG. 3) is attached to opposite sides 22 and 30 of the housing 20. With the detachable carrying strap 100 attached to the housing 20 and the foldable cushioned seat 80 in the folded position, the cooler 10 can be easily carried. Instead of snaps, the detachable strap 100 can be attached to the housing 20 via two buckles.

The housing 20 has a height of about twelve inches, a width of about twelve inches and a depth of about twelve inches. With the foldable cushioned seat 80 in the folded position, the cooler 10 has an overall height of about twenty inches, a width of about twelve inches and a depth of about twelve inches.

Accordingly, the combination cooler and cushioned seat 10 allows a person attending a NASCAR race, or other sporting event held at a stadium with benches, to attach the cooler 10 to the underside of a bench while using the foldable cushioned seat 80 as a comfortable seat with a backrest 84. Used in this manner, it allows a person to keep chilled food and beverages C close at hand while allowing access to the food and beverages C without having to stand up. The retractable table 28 can be used to support food items or beverages C, and the elastic side pouch 120 can be used to store small items, such as cigarettes and suntan lotion. The detachable carrying strap 100 can be used to carry the device 10 over a shoulder or with a hand. Also, when not mounted to a stadium bench, the cooler 10 can be used as a freestanding seat.

It is to be understood that the present invention is not limited to the embodiments described above, but encompasses any and all embodiments within the scope of the following claims.

We claim:

1. A portable combination cooler and cushioned seat adapted for attachment to a bench, comprising:

a drawer having a bottom, a back panel, a front panel, two side panels and an open top;

a housing having a top wall, a bottom wall, a back wall, a left wall, a right wall and a substantially open front forming a drawer cavity, the drawer being slidably disposed in the housing, the housing and the drawer being thermally insulated for use as a cooler;

at least one seat mounting bracket attached to the top wall of the housing, the bracket being adapted for mounting to the bench, wherein said at least one mounting bracket further comprises collapsible back support; and a foldable seat having a seat portion and a back portion; the seat portion being mounted to the at least one mounting bracket, the back portion being pivotally mounted to the seat portion for pivoting between an upright position and a folded horizontal position.

2. The portable combination cooler according to claim 1, further comprising a retractable table slidably disposed in said housing, the table being slidable between a retracted position in which the table is substantially disposed within said housing and an extended position in which the table extends laterally from said housing for supporting an object.

3. The portable combination cooler according to claim 1, further comprising:

a carrying strap having a first end and a second end; and means for attaching the first end of said carrying strap to the left wall of said housing and for attaching the second end of said carrying strap to the right wall of said housing.

4. The portable combination cooler according to claim 3, wherein said means for attaching comprises a snap fastener having a female component attached to said carrying strap and a male component attached to said housing.

5. The portable combination cooler according to claim 1, further comprising an elastic pouch attached to said housing.

6. The portable combination cooler according to claim 1, wherein said housing and said drawer are constructed of plastic.

7. The portable combination cooler according to claim 1, wherein said seat portion and said seat back are constructed of a cushioned material.

8. The portable combination cooler according to claim 1, wherein said seat portion is constructed of a cushioned material and said seat back is constructed of plastic.

9. The portable combination cooler according to claim 1, further comprising a handle attached to the front panel of said drawer.

10. The portable combination cooler according to claim 1, wherein said housing is about twelve inches high, about twelve inches wide and about twelve inches deep.

* * * * *